United States Patent [19]

Fisher

[11] 4,149,575

[45] Apr. 17, 1979

[54] CONTAINER

[76] Inventor: Larry F. Fisher, 4207 Tuckerman St., Hyattsville, Md. 20782

[21] Appl. No.: 763,807

[22] Filed: Jan. 31, 1977

[51] Int. Cl.[2] ..... B65B 3/04

[52] U.S. Cl. ..... 141/98; 220/85 F

[58] Field of Search ..... 141/98, 84, 199–205, 141/247, 297, 298, 299, 300, 331–345; 220/85 F, 85 SP, 86 R; 210/244

[56] References Cited

U.S. PATENT DOCUMENTS

| | | | |
|---|---|---|---|
| Re. 27,449 | 8/1972 | Bartz | 141/98 |
| 589,659 | 9/1897 | Krack | 220/86 R |
| 790,080 | 5/1905 | Seavy | 141/331 |
| 1,339,562 | 5/1920 | Hurt | 141/98 |

FOREIGN PATENT DOCUMENTS

| | | | |
|---|---|---|---|
| 429127 | 5/1926 | Fed. Rep. of Germany | 141/98 |

*Primary Examiner*—Houston S. Bell, Jr.

*Attorney, Agent, or Firm*—Roylance, Abrams, Berdo & Farley

[57] ABSTRACT

A container is provided for facilitating drainage of oil from an engine. A funnel is removably attached to the top of the container in a normally inverted position. The funnel can be removed, placed in an upright position and reattached to the top of the container for receiving and directing oil or other fluids into the interior of the container.

4 Claims, 2 Drawing Figures

CONTAINER

Figure 1:
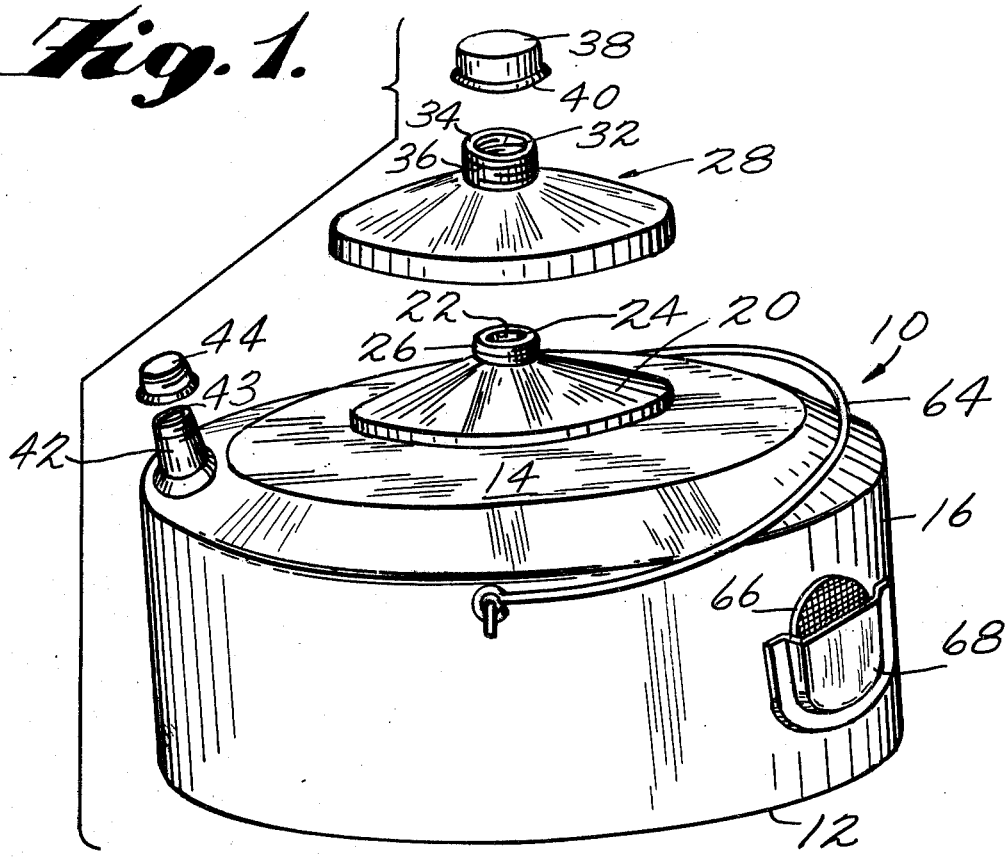

This invention relates to containers and more particularly to a reusable container for facilitating drainage of oil from an engine.

In order to save money, many people change the oil in their cars and other vehicles themselves. However, a frequent problem arises as to where to dump or otherwise dispose of the used oil without polluting the ground and nearby streams. If the oil is allowed to be placed into the sewer system, it ultimately appears in our streams and rivers. Oil has also recently become increasingly expensive and it is important to conserve our oil.

It is, therefore, an object of the present invention to provide a container which facilitiates drainage of oil from an engine.

Another object is to provide a container for collecting used engine oil so as to avoid pollution of the ground and/or rivers and streams.

A further object of the invention is the provision of a container which will enable an individual to change the oil in his automobile or other vehicle with a minimum of effort.

Still another object is to provide an inexpensive, reusable container for accepting used motor oil so as to reduce the amount of lead that ultimately appears in our rivers and streams via oil that otherwise would be dumped in sewers or onto the ground.

Yet another object of the present invention is the provision of a container for facilitating drainage of used motor oil from an engine so as to conserve oil and to provide a new source of home heating fuel by use of the used motor oil for that purpose.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a container having a bottom member, a top member, and at least one side member extending between the top and bottom members to define an interior cavity. The top member defines a substantially truncated conical surface and an opening for enabling passage of oil or other fluids into the cavity. More specifically, the container is provided with an externally threaded first neck number extending upwardly from the truncated surface and adjacent to the opening. A separate funnel member is also provided, and the funnel member defines a substantially truncated conical surface and a second neck member extending from the last-mentioned surface. The second or funnel neck member is preferably threaded on both an interior surface and an exterior surface thereof and the interior threads are threadably engageable with the external threads of the first neck member so that the funnel member can be normally positioned in an attached relationship to the top of the container.

In accordance with the invention, a separate cap member is also provided, and the cap member is threaded to engage the external threads of the second or funnel neck member so as to provide a cover for the container.

Preferably, the interior threads of the funnel neck member are threadably engageable with the external threads of the first neck member when the funnel member is in the inverted position and also when the funnel member is in an upright position. Thus, the funnel member can be attached to the top of the container when the container is not being used and also when the funnel member is being used to direct oil or other fluids into the container.

It should be understood that the foregoing general description and the following detailed description are exemplary and explanatory and are not restrictive of the invention.

Figure 2:
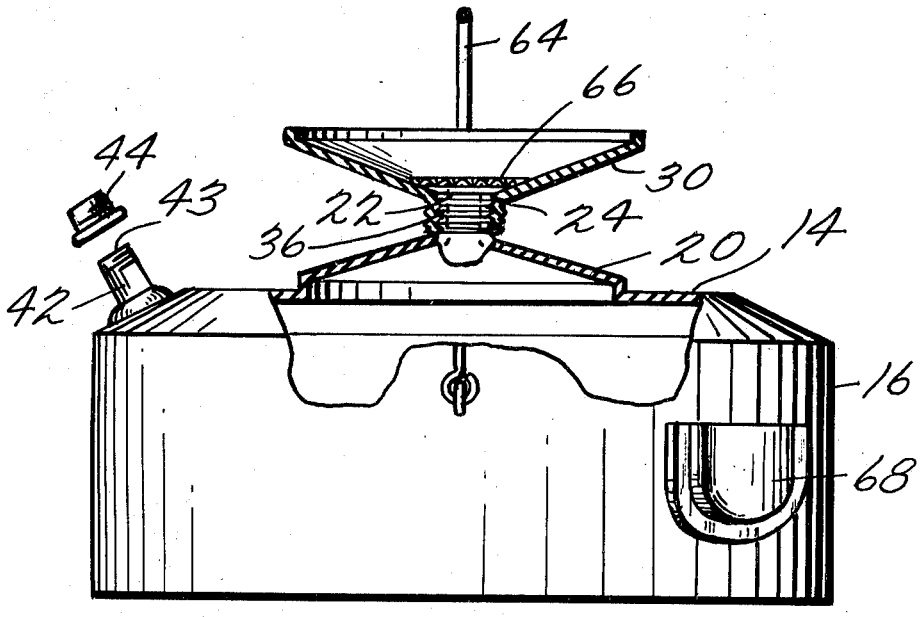

In the drawings:

FIG. 1 is an exploded perspective view of the invention showing the funnel member in inverted position for attachment to the top of the container and showing the cap removed; and FIG. 2 is an elevation view of the invention, partly in section, showing the funnel member attached to the top of the container in an upright position for directing oil into the interior of the container.

With reference now to the drawings, wherein like reference characters designate like or corresponding parts throughout the several views, there is shown a container 10 in accordance with this invention having a bottom member 12, a top member 14, and a side member 16 extending between the top and bottom members to define an interior cavity 18. Top member 14 defines a substantially truncated conical surface 20 and an opening 22.

A first neck member 24 extends upwardly from surface 20 and is positioned adjacent to opening 22. The exterior surface 26 of neck member 24 is threaded. A separate funnel member 28 defines a substantially truncated conical surface 30, and a second or funnel neck member 32 extends from surface 30. Neck member 32 is threaded on its interior surface 34 and also on its exterior surface 36. The threads on interior surface 34 of the funnel are threadably engageable with the threads located on exterior surface 26 of neck member 24.

A separate cap member 38 is also provided, and an interior surface 40 of the cap is threaded to engage the threads located on exterior surface 36 of the funnel member. A spout 42 also projects from side member 16 and a cap 44 is provided to be removably attached to the end of the spout and to close opening 43 defined by the spout. The end of spout 42 and the interior of cap 44 can be threaded or the cap can snap over the end of the spout to frictionally engage the spout.

The container also preferably includes a handle 64 attached to top member 14 and a generally circular screen member 66 for selective placement into funnel member 28 when the funnel member is positioned to direct oil into the container. (See FIG. 2). The screen member acts to prevent the oil pan nut or other objects from falling into the container. A holding member 68 is also provided and it is attached to side member 16 for holding the screen member when the screen member is not in use.

In operation or use of the invention, funnel member 28 is normally attached to the top of the container in an inverted position by engaging threads on interior surface 34 of the funnel member with the threads located on exterior surface 26 of neck member 24 (See FIG. 1). Cap member 38 is also normally attached to funnel member 28 by the threads located on exterior surface 36 of neck 32. Cap 44 will also be normally attached to spout 42 to cover opening 43.

When it is desired to drain oil from an engine or to otherwise introduce oil or other fluids into the container, cap 38 is unscrewed and removed from second neck member 32. Funnel member 28 is then unscrewed and removed from first neck member 24, and the funnel member is then placed into an upright position. The threads located on interior surface 34 of the funnel member then engage the threads located on exterior surface 26 of the container, and the funnel member is then screwed down into position on top of the container. (See FIG. 2). Screen member 66 is then removed from holding member 68 and placed into the funnel member. The container with member 28 attached thereto in an upright position can then be located directly beneath the exit port from the engine being drained. The oil pan nut (not shown) is then removed from the oil pan of the engine, and the oil will then flow through funnel member 28 and through opening 22 of the container into cavity 18. Screen member 66 will catch the oil pan nut and other objects to prevent them from falling into the container. The capacity of the container can be of any convenient size to accommodate the oil or other fluids being introduced thereto.

When the container is filled or when the drainage process is complete, screen member 66 is replaced into holding member 68 and funnel member 28 is unscrewed from its upright position on top of the container. The funnel member is then inverted and reattached to the top of the container by having the threads located on interior surface 34 of the funnel member engage the threads located on exterior surface 26 of the container. Cap 38 is then repositioned onto second neck member 32 of the funnel member by having the threads on surface 40 of the cap engage the threads located on exterior surface 36 of the funnel member.

The filled or partially filled container can then be transported to any suitable location for dumping its contents. Cap 44 is then removed from spout 42 and the container can then be tipped to enable the oil or other fluid to flow outwardly from cavity 18 through spout 42. Upon completion of removal of the oil or other fluid from the container, cap 44 is returned to its position covering opening 43 of the spout, and the container is then ready for reuse or cleaning.

Although the container is illustrated in a circular configuration, it should be understood that the container could be formed in many other shapes. However, it is important that surface 20 of the container be conical in nature to enable funnel member 28 to be screwed down on top of the container in the inverted position when the funnel member is not in use.

The container of this invention is a reuseable container and is not discarded after it has been filled with the used oil. It can be made of metal or of any other suitable material. By use of the container described herein, persons desiring to change motor oil in their vehicles at home can do so. The used oil placed into the container can be taken to service stations or other locations for reusing the oil. Much unused motor oil presently collected by service stations is recycled into home fuel. Thus, use of this container by individuals can result in conservation of our oil resources as well as preventing pollution by the dumping of used oil into the ground or streams.

The invention in its broader aspects is not limited to the specific details shown and described, and departures may be made from such details without departing from the principles of the invention and without sacrificing its chief advantages.

What is claimed is:

1. A container comprising:

a bottom member;

a top member; and at least one side member extending between said top and bottom members to define an interior cavity;

said top member defining an upright, substantially truncated conical surface and having an opening for enabling passage of fluid into said interior cavity;

said top member having a first hollow neck member with external threads thereon, said first hollow neck member extending from said truncated conical surface and upwardly from and aligned with said opening, a separate funnel member defining a substantially truncated conical surface and having a second hollow neck member extending from said last-mentioned conical surface, said second hollow neck member having threads on the interior surface thereof, said interior threads being threadably engageable with the external threads of said first neck member, wherein said separate funnel member is securable to said first neck member during storage by threadable engagement of the interior threads of said second hollow neck member with the exterior threads of said first neck member, the truncated conical surface of said funnel member overlying the truncated conical surface of said top member, and wherein said separate funnel member is securable during use by threadable engagement of the interior threads of said second hollow neck member with the exterior threads of said first neck member, the truncated conical surface of said funnel member being inverted from its storage position to receive fluid therein for funnelling through the threadably coupled first and second neck members, through said opening and into said interior cavity; and further including a spout attached to said top member to facilitate emptying the contents of the container from said interior cavity, a cap to be removably attached to said spout, and a screen member for selective placement within said funnel member and a holding member attached to said side member for holding said screen member when the screen member is not in use, said holding member and side member defining a sleeve open at the top for receiving the screen member and closed at the bottom for supporting the screen member and containing fluid dripping from the screen member.

2. A container as in claim 1 wherein:

said second hollow neck member has threads on the exterior surface thereof.

3. A container as in claim 2 further including a separate cap member threaded to engage the external threads of said second neck member.

4. A container as in claim 1 wherein:

said second hollow neck member extends upwardly from the smaller end of said funnel member conical surface.

* * * * *